United States Patent [19]

Takahashi et al.

[11] Patent Number: 4,910,129

[45] Date of Patent: Mar. 20, 1990

[54] SILVER HALIDE PHOTOGRAPHIC LIGHT SENSITIVE MATERIAL

[75] Inventors: Yoshiya Takahashi; Susumu Baba; Katsuaki Iwaosa; Motoshige Yamada; Kunihiro Nakagawa; Seigo Ebato; Hiroshi Nishinoiri; Yoshikazu Takaya, all of Nagaokakyo, Japan

[73] Assignee: Mitsubishi Paper Mills, Ltd., Tokyo, Japan

[21] Appl. No.: 181,008

[22] Filed: Apr. 13, 1988

[30] Foreign Application Priority Data

| | | | |
|---|---|---|---|
| Apr. 17, 1987 | [JP] | Japan | 62-94499 |
| May 25, 1987 | [JP] | Japan | 62-129420 |
| Jul. 7, 1987 | [JP] | Japan | 62-170794 |

[51] Int. Cl.[4] ..... G03C 1/20; G03C 1/28

[52] U.S. Cl. ..... 430/573; 430/572; 430/576; 430/577; 430/584; 430/611; 430/944

[58] Field of Search ..... 430/573, 611, 944, 577, 430/584, 614, 572, 576

[56] References Cited

U.S. PATENT DOCUMENTS

| | | | |
|---|---|---|---|
| 3,592,656 | 7/1971 | Brooks | 430/572 |
| 3,945,829 | 3/1976 | Zorn et al. | 430/611 |
| 4,264,721 | 4/1981 | Shimano et al. | 430/551 |
| 4,542,094 | 9/1985 | Koshizuka et al. | 430/569 |
| 4,596,767 | 6/1986 | Mihara et al. | 430/576 |
| 4,603,104 | 7/1986 | Philip, Jr. | 430/572 |
| 4,631,253 | 12/1986 | Mifune et al. | 430/569 |
| 4,683,192 | 7/1987 | Nishiyama | 430/567 |
| 4,770,961 | 9/1988 | Tanaka et al. | 430/14 |
| 4,770,991 | 9/1988 | Kojima et al. | 430/611 |
| 4,780,404 | 10/1988 | Sills et al. | 430/572 |
| 4,784,938 | 11/1988 | Obhayashi et al. | 430/505 |

FOREIGN PATENT DOCUMENTS

| | | |
|---|---|---|
| 69063 | 10/1984 | Japan . |
| 191032 | 10/1984 | Japan . |

*Primary Examiner*—Paul R. Michl
*Assistant Examiner*—Mark R. Buscher
*Attorney, Agent, or Firm*—Cushman, Darby & Cushman

[57] ABSTRACT

Disclosed is a silver halide photographic light sensitive material which has a silver halide emulsion layer optically sensitized with a sensitizing dye having a maximum spectral sensitivity in the region of at least 700 nm, said emulsion layer containing at least one compound represented by the following formula (I) or at least one compound represented by the general formula (I) and at least one compound represented by the general formula (II) in combination:

(I)

(wherein $R_1$ and $R_2$ each represents a hydrogen atom, an alkyl group, an aryl group, an aralkyl group, an alkenyl group, an amino group, an acylamido group or a sulfonamido group and sum of carbon atom numbers of $R_1$ and $R_2$ is 3 or more.);

(II)

(wherein $R_3$ represents an alkyl group of at least 3 carbon atoms or an aryl group).

5 Claims, No Drawings

SILVER HALIDE PHOTOGRAPHIC LIGHT SENSITIVE MATERIAL

BACKGROUND OF THE INVENTION

The present invention relates to a silver halide photographic light sensitive material spectrally sensitized in infrared region.

With recent rapid progress of information transmitting systems, silver halide photographic light sensitive materials have been increasingly required to have high sensitivity. Such systems are, for example, high speed phototypesetting system according to which information output from electronic computer is immediately displayed as letters or figures by cathode ray tube and press facsimile system for rapid transmission of news paper originals to a remote place.

Characteristics required for silver halide photographic light sensitive materials for these uses are high sensitivity to so-called high intensity-short time exposure (flash exposure), namely, exposure for $10^{-4}$ second or less with light sources, e.g., lasers such as cathode ray tube (CRT), helium-neon gas laser and light emission diode (LED), high contrast and high resolving power.

The method of using laser light sources such as helium-neon and argon as a scanning type light source has the defects that large and expensive devices are necessary and efficiency of consumed power is low. On the other hand, semiconductor laser has the advantages that it is small in size, inexpensive, easily modulatable and long in life. For semiconductor laser, there are used semiconductors of such systems as Ga/As/P; Ga/Al/As; Ga/As; In/P; In/As and the like and wavelength of these laser beams is generally longer than 700 nm and largely is longer than 750 nm.

Therefore, bright safelight can be used and thus handleability is good. However, light sensitive materials for infrared rays are generally not so high in sensitivity and inferior in shelf stability and various proposals have been made in an attempt to solve these problems. For example, a technique called supersensitization effect has been proposed according to which spectral sensitivity is markedly enhanced by adding a specifically selected organic compound in addition to spectral sensitizing dye. Reference may be made to, for example, triazine derivatives disclosed in U.S. Pat. Nos. 2,785,058 and 3,695,888, mercapto compounds having electronegative group disclosed in U.S. Pat. No. 3,457,078, benzotriazole derivatives disclosed in Japanese Patent Unexamined Publication (Kokai) No. 81613/76, quaternary salts disclosed in Japanese Patent Unexamined Publication (Kokai) No. 191032/84 and others disclosed in Japanese Patent Unexamined Publication (Kokai) Nos. 69063/86 and 27884/86. However, many of these supersensitization techniques provide unsatisfactory results such as insufficient sensitization, increase of fog and decrease in shelf stability.

As a result of the inventors' intensive research on silver halide photographic light sensitive materials for semiconductor laser beam which are free from the above mentioned problems, it has been found that some compounds are markedly effective for this purpose.

SUMMARY OF THE INVENTION

One object of the present invention is to provide a silver halide photographic light sensitive material enhanced in sensitivity in infrared region such as semiconductor laser beams, which is longer than 700 nm, especially longer than 750 nm.

Another object of the present invention is to provide a silver halide photographic material which is enhanced in sensitivity in infrared region and has no problems in fog and shelf stability.

The above objects have been attained by a silver halide photographic light sensitive material having silver halide emulsion layer which is optically sensitized with a sensitizing dye having a maximum spectral sensitivity in the region longer than 700 nm and which contains at least one compound represented by the following general formula (I) or at least one compound represented by the general formula (I) and at least one compound represented by the general formula (II) in combination:

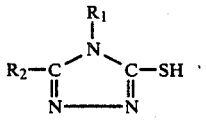

(I)

(wherein $R_1$ and $R_2$ each represents a hydrogen atom, an alkyl group, and aryl group, an aralkyl group, an alkenyl group, an amino group, an acylamide group or a sulfonamide group and sum of carbon atom numbers of $R_1$ and $R_2$ is 3 or more.);

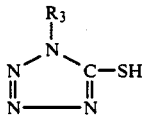

(II)

(wherein $R_3$ represents an alkyl group of at least 3 carbon atoms or an aryl group).

DESCRIPTION OF THE INVENTION

Examples of the compounds represented by the general formula (I) are shown below. (Only $R_1$ and $R_2$ are shown.)

| Compound | $R_1$ | $R_2$ |
|---|---|---|
| (I-1) | 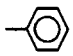 | $-C_2H_5$ |
| (I-2) | 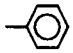 | 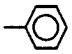 |
| (I-3) | $-NH_2$ | 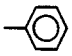 |
| (I-4) | $-NHSO_2-$ 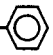 | 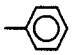 |
| (I-5) | $-NHCO-$ 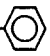 | 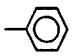 |
| (I-6) | $-NHCO-$ 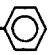 | $-n.C_7H_{15}$ |
| (I-7) | $-NHSO_2-$ 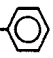 | $-CH_3$ |

-continued

| Compound | $R_1$ | $R_2$ |
|---|---|---|
| (I-8) | $-CH_2CH=CH_2$ | 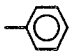 |
| (I-9) | $-CH_2-$ 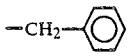 | $-CH_3$ |
| (I-10) | $-n.C_3H_7$ | $-CH_3$ |
| (I-11) | $-NHCOC_2H_5$ | 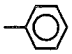 |
| (I-12) | $-H$ | $-CH_2-$ 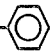 |
| (I-13) | $-C_2H_5$ | 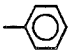 |
| (I-14) | 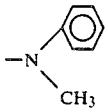 | 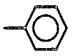 |
| (I-15) | $C_2H_5$ | $CH_3$ |
| (I-16) | $CH_2CH=CH_2$ | $CH_2$ |
| (I-17) | $-NHCOC_2H_5$ | $n-C_7H_{15}$ |
| (I-18) | $CH_3$ | $n-C_3H_{11}$ |
| (I-19) | $-H$ | $-CH=CH-CH_3$ |
| (I-20) | $-NHCOC_2H_5$ | $-NHCOC_2H_5$ |
| (I-21) | $-NHSO_2-$ 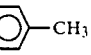 $-CH_3$ | $-NHSO_2-$ 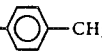 $-CH_3$ |

Examples of the compounds represented by the general formula (II) are shown below. (Only $R_3$ is shown.)

| Compound | $R_3$ |
|---|---|
| (II-1) | 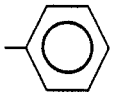 |
| (II-2) | 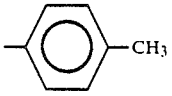 $-CH_3$ |
| (II-3) | 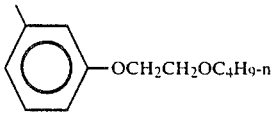 $-OCH_2CH_2OC_4H_9-n$ |
| (II-4) | 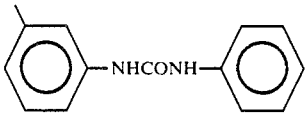 $-NHCONH-$ |

-continued

| Compound | $R_3$ |
|---|---|
| (II-5) | 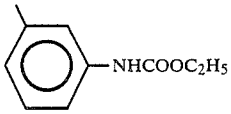 $-NHCOOC_2H_5$ |
| (II-6) | 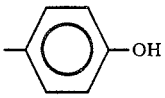 $-OH$ |
| (II-7) | 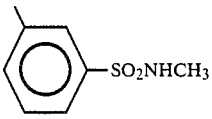 $-SO_2NHCH_3$ |
| (II-8) | 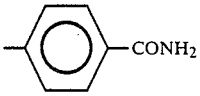 $-CONH_2$ |
| (II-9) | 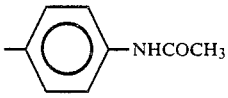 $-NHCOCH_3$ |
| (II-10) | 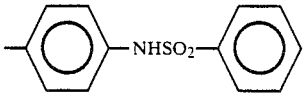 $-NHSO_2-$ |
| (II-11) | 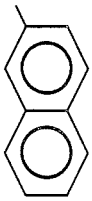 |
| (II-12) | $-n.C_5H_{11}$ |
| (II-13) | $-n.C_8H_{17}$ |

At least one of the compound represented by the formula (I) or at least one of the compound represented by the formula (II) in combination with compound (I) are added to the silver halide emulsion at any time before coating on a support, preferably before completion of physical ripening. More preferably, they are added before grain size of emulsion grains exceeds 50% of grain size obtained at the time of completion of physical ripening. When they are added thereafter, grain size distribution may expand. These compounds have the action to suppress the progress of physical ripening, to narrow the grain size distribution and further to arrange the crystal form to cubic form. Making fine emulsion grains by suppressing progress of physical ripening has the effect to increase covering power of the emulsion and thus saving of silver in silver halide light sensitive materials can be attained. Arrangement of the crystal form to cubic form is very advantageous for efficiency of spectral sensitization as well known and this is effective for obtaining high sensitivity light sensitive materials. Narrowing the grain size distribution is effective for obtaining high contrast emulsions and besides, crystal of desired average grain size can be obtained by controlling addition amount of the compounds and position of addition of the compounds. These compounds may be added to the emulsion layer by diffusing them from a contiguous hydrophilic colloid layer.

Addition amount of the respective compound is $5\times10^{-3}$–5 mmols, preferably $1\times10^{-2}$–1 mmol per 1 mol of silver halide. When compounds (I) and (II) are used in combination, molar ratio thereof may be optionally changed within the range of 1:9–9:1. It is preferred to add them as solutions in suitable solvents such as methanol, ethanol, propanol, acetone and dimethylformamide. When compounds (I) and (II) are used in combination, they may be used as one solution or as separate solutions at different time.

The sensitizing dyes used in the present invention which have maximum spectral sensitivity in a wavelength region longer than 700 nm and may be those which are disclosed in U.S. Pat. Nos. 2,095,854, 2,095,856, 2,955,939, 3,482,978, 3,522,974, 3,573,921, 3,582,344 and 3,623,881.

Preferably, those represented by the following general formulas (III)–(VI) are used.

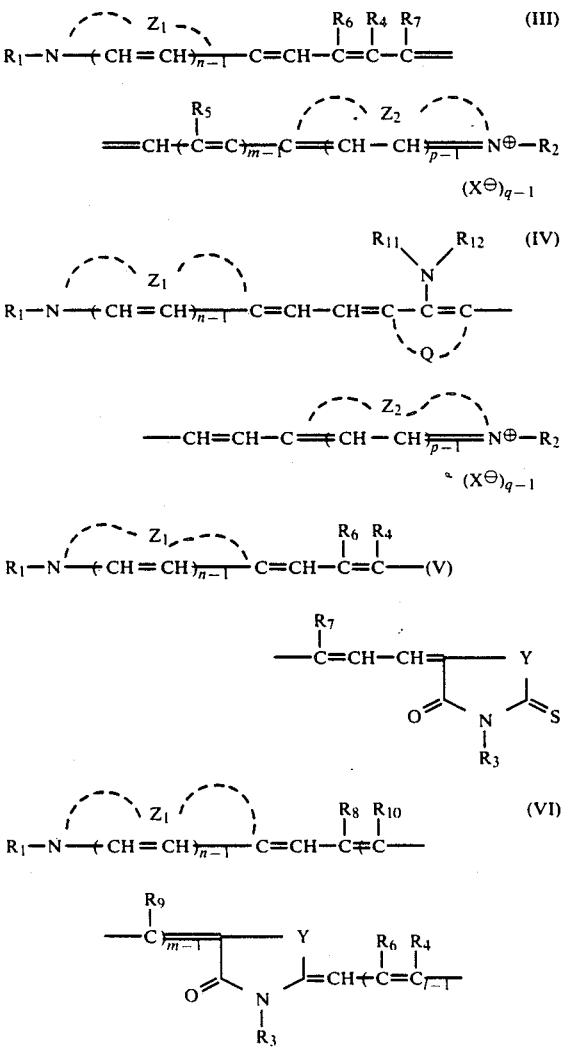

-continued

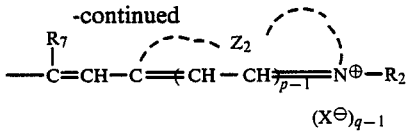

In the above formulas (III)–(VI), $Z_1$ and $Z_2$ which may be identical of different each represents group of atoms necessary to form 5-membered or 6-membered nitrogen-containing heterocyclic ring; $R_1$ and $R_2$ which may be identical or different each represents an alkyl group or an alkenyl group; $R_3$ represents an alkyl group, an alkenyl group or an aryl group; $R_4$–$R_{10}$ which may be identical or different each represents a hydrogen atom, a halogen atom, an alkyl group, an aryl group or an alkoxy group and $R_6$ and $R_7$ or $R_8$ and $R_9$ may link to each other to form a 5-membered or 6-membered ring; $R_{11}$ and $R_{12}$ which may be identical or different each represents an alkyl group or an aryl group and may link to each other to form a 5-membered or 6-membered ring; Y represents a sulfur atom, an oxygen atom, $>N-R_{13}$ ($R_{13}$ is an alkyl group), X represents an acid anion; l, m, n, p and q each represents 1 or 2 and Q represents a group of atoms necessary to form 5-membered or 6-membered ring.

As examples of $Z_1$ and $Z_2$, mention may be made of nitrogen-containing heterocyclic rings such as thiazole, benzothiazole, naptho[1,2-d]thiazole, naphtho[2,1-d]thiazole, naphtho[2,3-d]thiazole, selenazole, benzoselenazole, naphtho[2,1-d]selenazole, naphtho[1,2-d]selenazole, oxazole, benzoxazole, naphtho[1,2-d]oxazole, naphtho[2,1-d]oxazole, naphtho[2,3-d]oxazole, 2-quinoline, 4-quinolene, 3,3-dialkylindolenine, imidazole, benzimidazole, naphtho[1,2-d]imidazole and pyridine. These heterocyclic rings may have at least one substituent such as, for example, alkyl group (e.g., methyl, ethyl, butyl and trifluoromethyl), aryl group (e.g., phenyl and tolyl), hydroxy group, alkoxy group (e.g., methoxy, ethoxy and butoxy), carboxyl group, alkoxycarbonyl group (e.g., methoxycarbonyl and ethoxycarbonyl), halogen atom (e.g., fluorine, chlorine, bromine and iodine), aralkyl group (e.g., benzyl and phenethyl), cyano group and alkenyl group (e.g., allyl).

As alkyl groups for $R_1$ and $R_2$, mention may be made of, for example, lower alkyl groups such as methyl, ethyl, propyl and butyl, hydroxyalkyl groups such as β-hydroxyethyl and γ-hydroxypropyl, alkoxyalkyl groups such as β-methoxyethyl and γ-methoxypropyl, acyloxyalkyl groups such as β-acetoxyethyl, γ-acetoxypropyl and β-benzoyloxyethyl, carboxyalkyl groups such as carboxymethyl and β-carboxyethyl, alkoxycarbonylalkyl groups such as methoxycarbonylmethyl, ethoxycarbonylmethyl and β-ethoxycarbonylethyl, sulfoalkyl groups such as β-sulfoethyl, γ-sulfopropyl and δ-sulfobutyl and aralkyl groups such as benzyl, phenethyl and sulfobenzyl. Alkenyl groups for $R_1$ and $R_2$ include, for example, allyl group.

As $R_3$, there are alkyl and alkenyl groups as exemplified for $R_1$ and $R_2$ and aryl groups such as, for example, phenyl, tolyl, methoxyphenyl, chlorophenyl and naphthyl.

$R_4$–$R_{10}$ each represents a hydrogen atom, a halogen atom (e.g., chlorine, bromine, iodine and fluorine), an alkyl or aryl group as exemplified for $R_1$ and $R_2$ or an alkoxy group having an alkyl group as exemplified for $R_1$ and $R_2$ (namely, $OR_1$) and 5-membered or 6-membered ring formed by $R_6$ and $R_7$ or $R_8$ and $R_9$ may have substituent such as lower alkyl group. $R_{11}$ and $R_{12}$ each represents an alkyl group or an aryl group as exemplified for $R_1$ and $R_2$ and $R_{11}$ and $R_{12}$ may link to each other to form a 5-membered or 6-membered ring. $R_{13}$ represents an alkyl group as exemplified for $R_1$ and $R_2$.

The acid anions of X include, for example, alkylsulfate ions such as methylsulfate and ethylsulfate, thiocyanate ion, toluenesulfonate ion, halogen ions such as chloride, bromide and iodide and perchlorate ion. The acid anion is not present when the dye has a betaine analogous structure.

Examples of the sensitizing dyes use in the present invention are enumerated below.

(1)

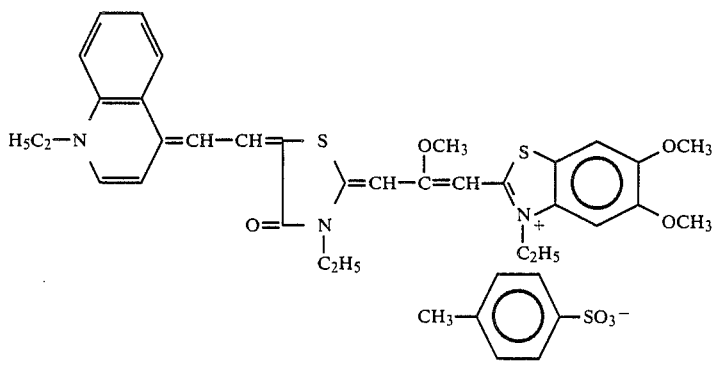

(2)

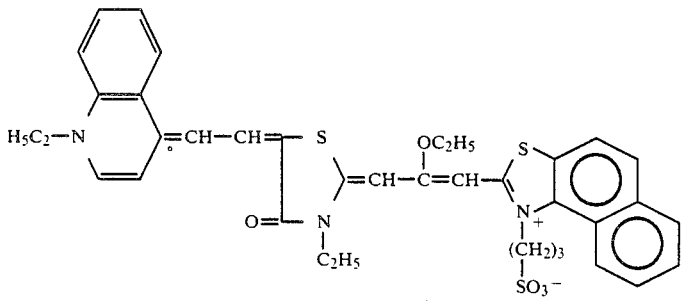

(3)

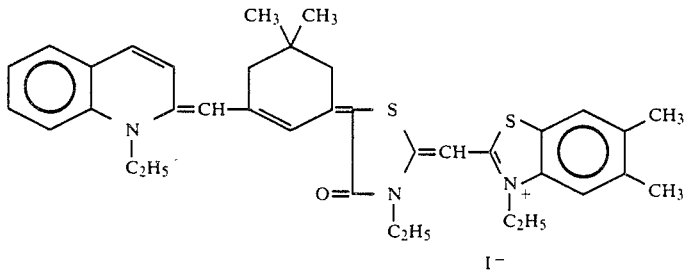

(4)

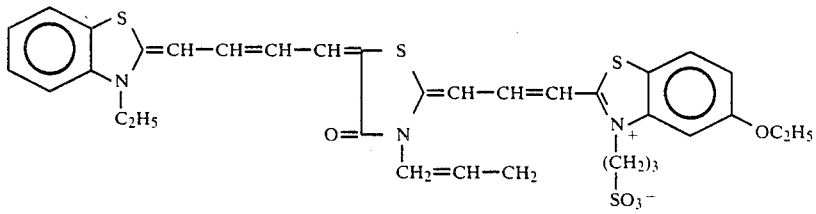

(5)

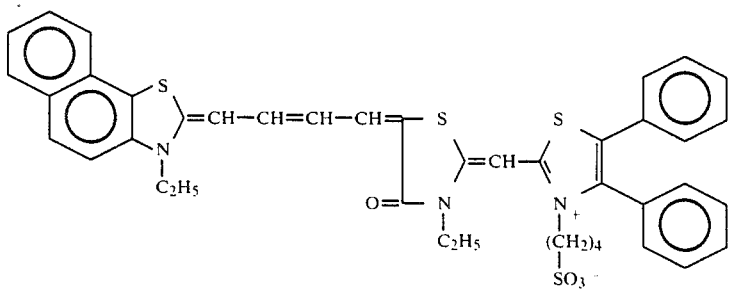

-continued
(6)
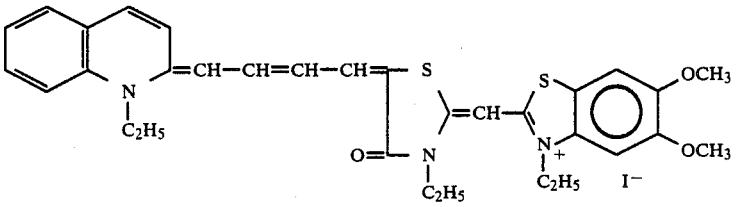
(7)
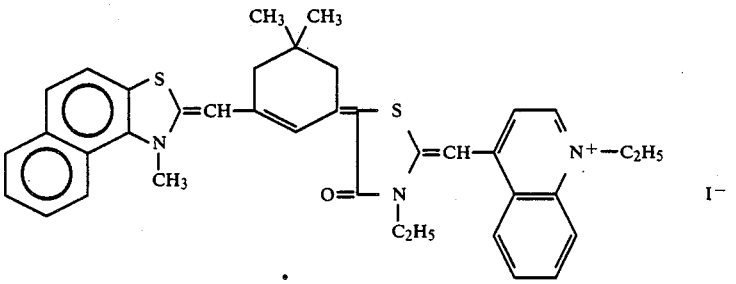
(8)
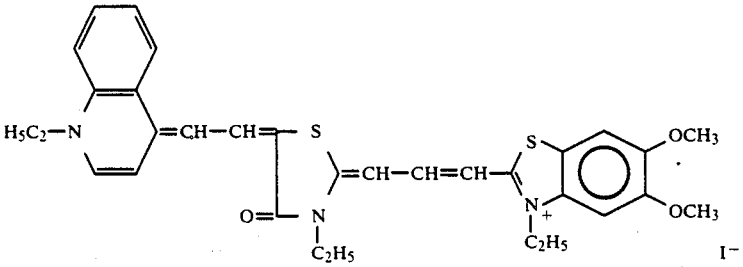
(9)
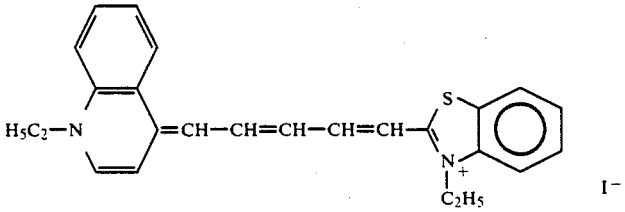
(10)
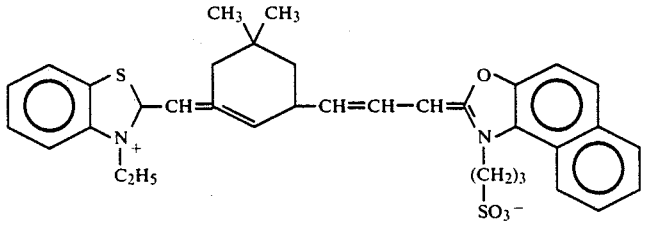
(11)
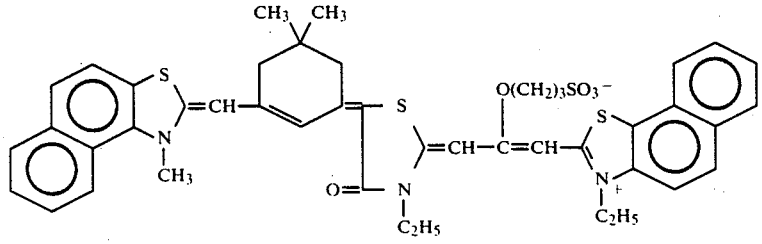

-continued
(12)
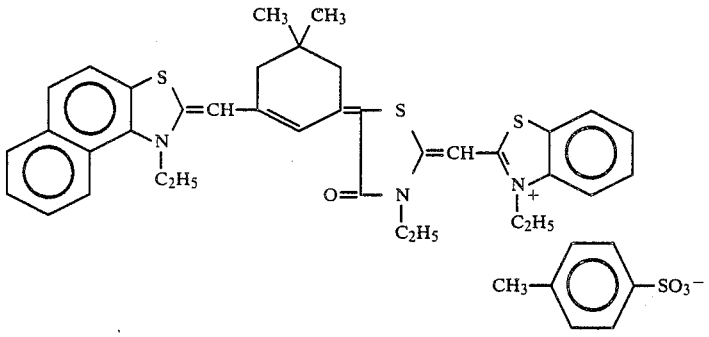
(13)
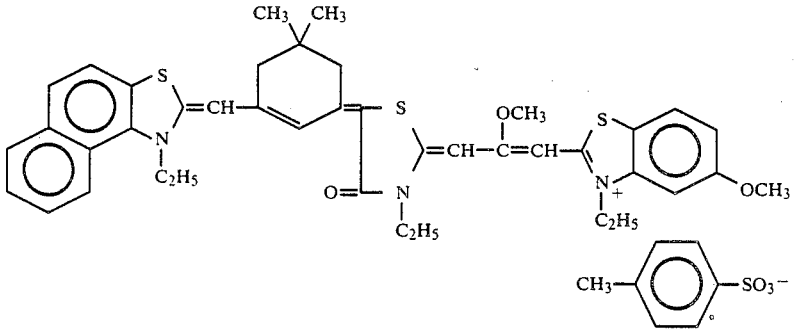
(14)
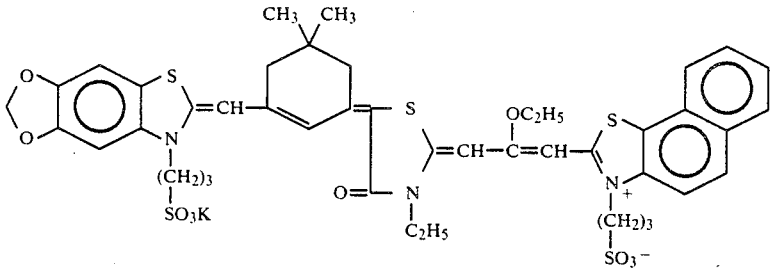
(15)
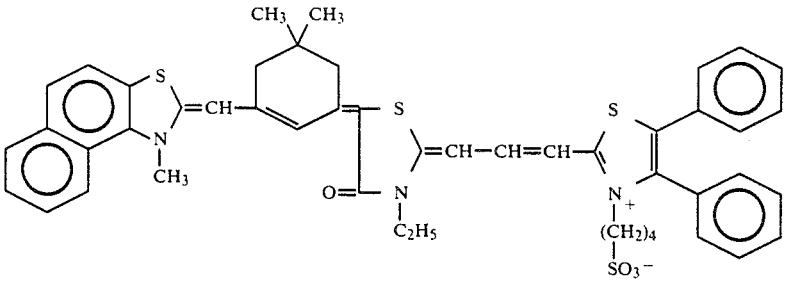
(16)
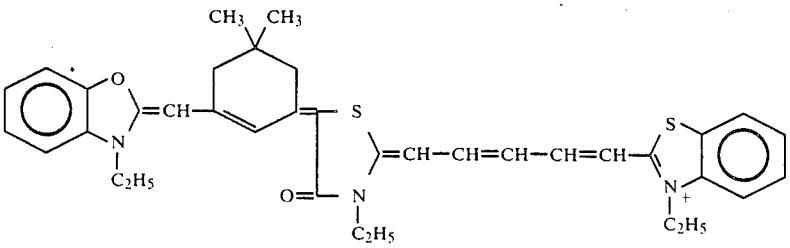

-continued
(17)
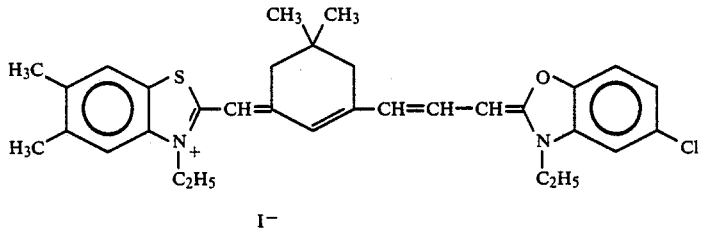
(18)
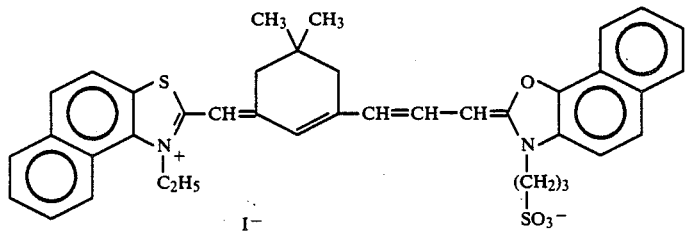
(19)
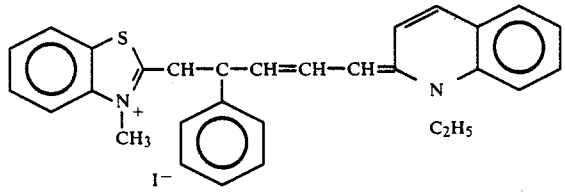
(20)
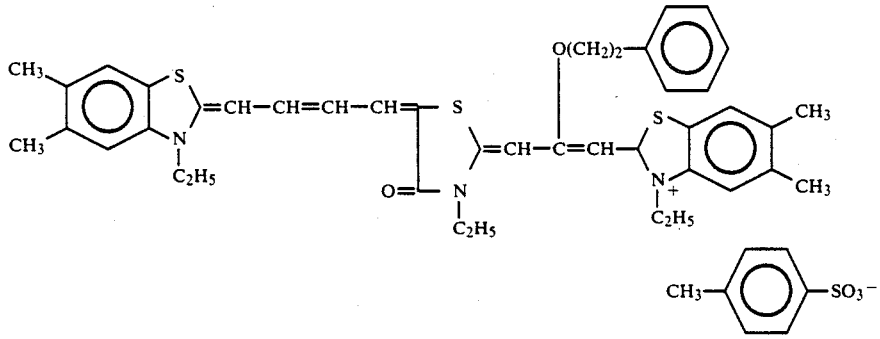
(21)
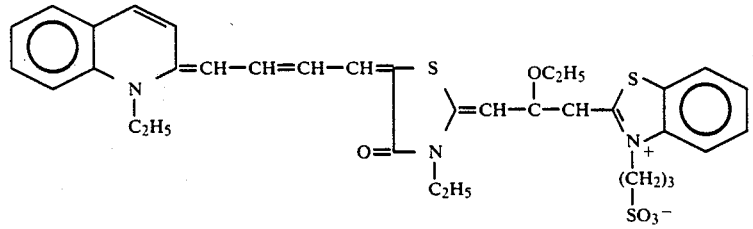
(22)
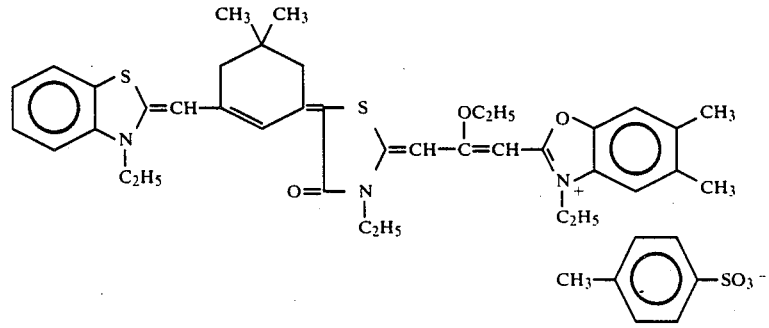

-continued
(23)
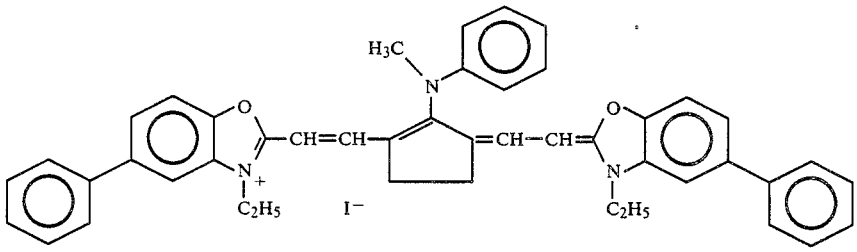
(24)
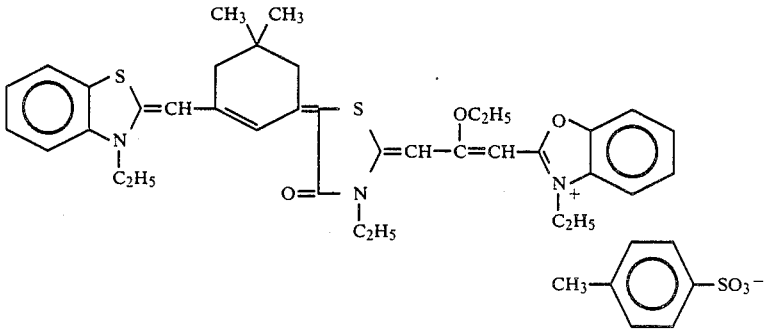
(25)
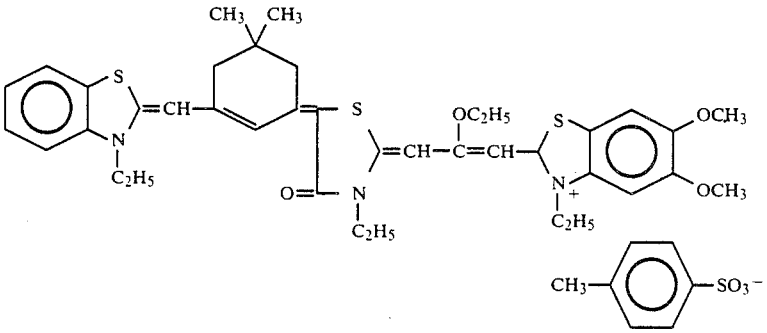
(26)
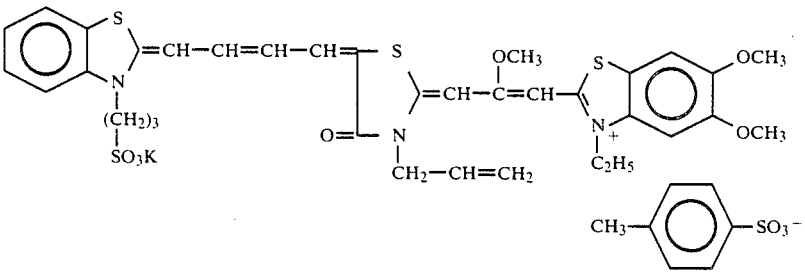
(27)
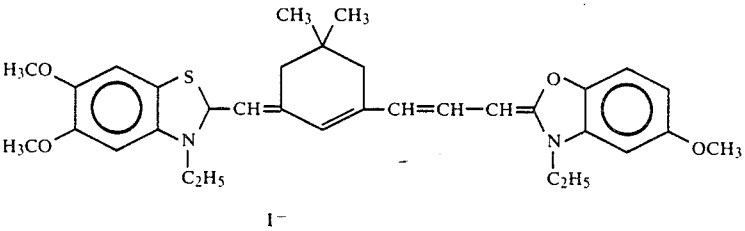
(28)
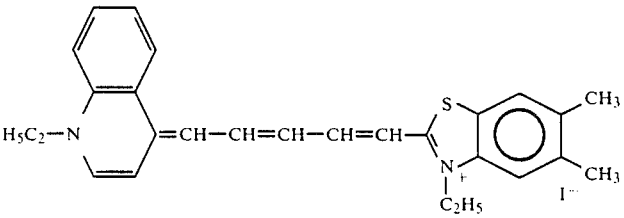

-continued (29)

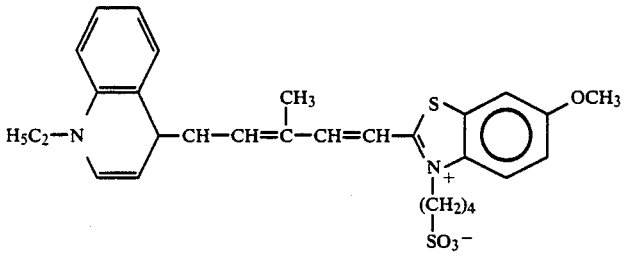

(30)

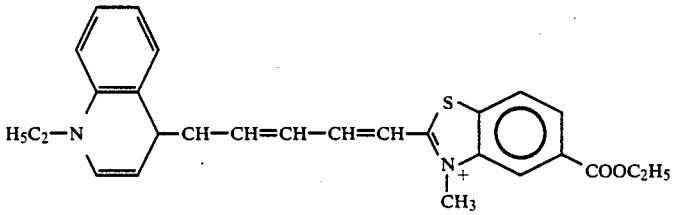

(31)

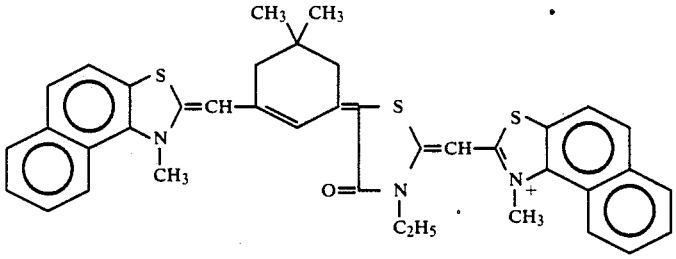

I⁻

The sensitizing dyes used in the present invention may be synthesized by the methods known per se. These dyes may be added to silver halide emulsion at any time before coating on a support and may be added simultaneously with or before or after the addition of the compound (I) and/or the compound (II).

Addition amount of the sensitizing dye is $1\times10^{-6}$-$1\times10^{-3}$ mol, preferably $5\times10^{-6}$-$5\times10^{-4}$ mol per 1 mol of silver halide.

The sensitizing dye may be directly dispersed in emulsion or may be dissolved in a water-miscible solvent such as methanol, ethanol, pyridine, methyl cellosolve, acetone or dimethylformamide (or a mixed solvent thereof) or diluted with water or dissolved in water and added to emulsion in the form of such solution. Ultrasonic vibration can be applied to this dye solution or the solution may be added by the methods disclosed in U.S. Pat. No. 3,469,987 and Japanese Patent Examined Publication (Kokoku) No. 24185/71: Further, there may be used such methods as disclosed in U.S. Pat. Nos. 2,912,345, 3,342,605, 2,996,287 and 3,425,835.

The silver halide emulsion used in the present invention may be prepared by various known methods.

The silver halide emulsion used in the present invention may be prepared by any precipitation methods, so-called single jet method or controlled double jet method. Crystal habits of the silver halide grains may be any of cubic, octahedral, tetradecahedral or tablet form.

Halogen composition of silver halide used in the present invention may be, for example, any of silver chloride, silver bromide, silver chlorobromide or mixtures thereof with silver iodide.

Metals such as rhodium and iridium may be used during precipitation or physical ripening of silver halide.

These emulsions can be chemically sensitized by known methods. That is, sulfur sensitization can be carried out with sulfur compounds disclosed in U.S. Pat. Nos. 1,574,944, 2,278,947, 2,410,689, 3,189,458 and 3,501,313 or sensitizing-type gelatins containing the sulfur compounds. Further, gold sensitization may also be effected with gold compounds disclosed in U.S. Pat. Nos. 2,597,856, 2,597,915 and 2,399,083. Moreover, there may also be effected reduction sensitization as disclosed in U.S. Pat. Nos. 2,518,698, 2,521,925, 2,487,850 and 2,694,637. These sensitizations may also be carried out in combination.

The photographic emulsions used in the present invention can also be sensitized with quaternary ammonium salts, thioether compounds, polyethylene oxide derivatives and diketones. These methods are disclosed in U.S. Pat. Nos. 2,708,162, 3,046,132, 3,046,133, 3,046,134 and 3,046,135 and British Patent No. 939,357.

Various hydrophilic colloids are used in the photographic light sensitive materials of the present invention. As hydrophilic colloids used as vehicles for photographic emulsions and/or other photographic layers, mention may be made of, for example, gelatin, colloidal albumin, casein, cellulose derivatives such as carboxymethyl cellulose and hydroxyethyl cellulose, sugar derivatives such as agar, sodium alginate and starch derivatives, synthetic hydrophilic colloids such as polyvinyl alcohol, poly N-vinylpyrrolidone, polyacrylic acid copolymer, polyacrylamide or derivatives or partial hydrolyzates thereof. If necessary, compatible mixtures of two or more of these colloids may also be used. Among them, gelatin is most commonly used. A part or the whole of the gelatin may be replaced with synthetic high molecular substance. Moreover, the gelatin may be replaced with so-called gelatin derivatives, namely, those in which amino group, imino group, hydroxy group or carboxy group as functional group contained in molecule is treated and modified with a chemical having one group reactive with the above groups or graft polymers to which molecular chain of other high molecular substance is bonded.

The photographic light sensitive material of the present invention may contain inorganic or organic hardeners in photographic emulsion layer or other hydrophilic colloid layers. For example, the following are used alone or in combination: chromium salts (e.g., chrome alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxy dioxane), active vinyl compounds (e.g., 1,3,5-triacryloylhexahydro-S-triazine and 1,3-vinylsulfonyl-2-propanol), active halogen compounds (e.g., 2,4-dichloro-6-hydroxy-S-triazine) and mucohalogenic acids (e.g., mucochloric acid and mucophenoxychloric acid).

Further, photographic emulsion layer or other hydrophilic colloid layers of the light sensitive material of the present invention may contain various surface active agents for various purposes such as coating aid, antistatic agent, improvement of slipping property, emulsification dispersion and anti-tacking agent.

Examples of the surface active agents are non-ionic surface active agents such as saponin (steroid type), alkylene oxide derivatives (for example, polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides and polyethylene oxide adducts of silicon), glycidol derivatives (for example, alkenylsuccinic acid polyglycerides and alkylisoenol polyglycerides), fatty acid esters of polyhydric alcohols and alkyl esters of sugars; anionic surface active agents having acidic group such as carboxyl group, sulfo group, phospho group, sulfuric acid ester group or phosphoric acid ester group such as alkylcarboxylic acid salts, alkylsulfonic acid esters, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylenealkylphenyl ethers and polyoxyethylenealkylphosphoric acid esters; cationic surface active agents such as amphoteric surface active agents such as amino acids, aminoalkylsulfonic acids, aminoalkylsulfuric acid or phosphoric acid esters, alkylbetaines and amine oxides; alkylamine salts, aliphatic or aromatic quaternary ammonium salts, heterocyclic quaternary ammonium salts and aliphatic or heterocyclic ring-containing phosphonium or sulfonium salts. Further, properties of gelatin films can be modified by adding latex polymers or surface of the films can be matted by adding silica, starch powder, colloidal silica or glass powder.

Photographic emulsion layer and other hydrophilic colloid layers of the light sensitive material of the present invention may contain various compounds in addition to the compound represented by the formula (I) and (II) in order to prevent fogging which may occur during preparation of the light sensitive material, storage of the material or during photographic processing. That is, there may be used various compounds known as antifoggants or stabilizers, for example, azoles such as benzothiazolium salts, nitroindazoles, triazoles, benzotriazoles and benzimidazoles (especially nitro- or halogen substitutes); heterocyclic mercapto compounds such as mercaptothiazoles, mercaptobenzothiazoles, mercaptobenzimidazoles, mercaptothiadiazoles, and mercaptopyrimidines; the above heterocyclic mercapto compounds having water-soluble groups such as carboxyl group and sulfon group; thioketo compounds such as oxazolinthion; azaindenes such as tetrazeindenes (especially, 4-hydroxy substituted (1,3,3a,7)-tetrazaindenes); benzenethiosulfonic acids; and benzenesulfinic acids.

In the light sensitive materials of the present invention, there may be used other various compounds such as antistatic agents, ultraviolet absorbers, plasticizers, developing agents, antihalation dyes, fluorescent dyes, development accelerators and couplers.

As supports of the light sensitive materials of the present invention, there may be used all of those which are ordinarily used as supports for photographic light sensitive materials such as, for example, cellulose nitrate film, cellulose acetate film, cellulose acetate butyrate film, cellulose acetate propionate film, polystyrene film, polyethylene terephthalate film, polycarbonate film and laminates thereof and papers. Further suitable supports are baryta paper, papers coated or laminated with $\alpha$-olefin polymers, especially polymers of $\alpha$-olefins of 2–10 carbon atoms such as polypropylene and plastic films the surface of which is roughened to improve close contact with other high molecular substances and increase printability as disclosed in Japanese Patent Examined Publication (Kokoku) No. 19068/72.

The hydrophilic colloid layers may be coated by the methods, such as, for example, air doctor coating, blade coating, squeeze coating, air knife coating, reverse roll coating, cast coating and extrusion coating. Coating amount is preferably 1–15 $\mu$m, more preferably 2–10 $\mu$m.

The light sensitive material of the present invention is useful for monochromatic photographic light sensitive materials for semiconductor laser and lithographic printing plates made using silver complex diffusion transfer process, but can also be used for other uses.

The following nonlimiting examples further explain the present invention.

EXAMPLE 1

Emulsion (A) was prepared from the following formulations.

| | |
|---|---|
| Liquid I | |
| Gelatin | 100 g |
| Distilled water | 2000 ml |
| Potassium bromide | 130 g |
| Liquid II | |
| Silver nitrate | 170 g |
| Distilled water | 1000 ml |
| 28% Ammonia water | 150 ml |

Liquid I was kept at 40° C. and liquid II was added thereto under vigorous stirring. The mixture was ripened at 40° C. for 30 minutes and then pH was lowered to 6.0. Then, 100 g of gelatin was added and was dissolved, followed by cooling, coagulating, macerating and desalting by washing with water.

Separately, 50 mg of the above exemplified compound (I-5) was dissolved in methanol and this solution was previously added to liquid I and thereafter, emulsion (B) was prepared by mixing and ripening in the same manner as in preparation of emulsion (A).

Shape and grain size distribution of the thus obtained emulsions (A) and (B) were observed by an electron microscope to find that in the emulsion (A), grains of various shapes such as cube, triangle, octahedron and the like were present while in the emulsion (B), all grains were cubic and that grain size distribution of the emulsion (A) was in the wide range of 0.3–1.5 μ and means grain size was 0.7 μ while grain size distribution of emulsion (B) was in the very narrow range of 0.35–0.45 μ and means grain size thereof was about 0.4 μ.

The thus prepared emulsions (A) and (B) were respectively dissolved and adjusted to pH 6.5 and pAg 8.9. Then, 40 mg of sodium thiosulfate per 1 mol of silver halide and 15 mg of ammonium gold thiocyanate per 1 mol of silver halide were added and chemical ripening was effected at 55° C. for 60 minutes. After ripening, 1-phenyl-5-mercaptotetrazole was added in an amount of 300 mg per 1 mol of silver halide.

These emulsions were divided into some portions and to each of them was added 10 mg of the above exemplified sensitizing dye (10) per 1 mol of silver halide. Thereafter, these emulsions were left to stand at about 40° C. for 45 minutes to stabilize the spectral sensitizing action, followed by adding a stabilizer, a coating aid and a hardener. Then, each of them was coated on a polyethylene-laminated paper support and this was dried to obtain a sample.

Each sample was exposed using an actinometer having a light source of color temperature 5,400° K., to which a dark red filter which transmitted light having a wavelength longer than 700 nm was attached. Then, each sample was developed with D-72 developer at 20° C. for 90 seconds, stopped, fixed and further washed with water to obtain a strip having the predetermined black and white images.

Density of the images was measured by MACBETH TD-504 densitometer manufactured by Macbeth Corporation to obtain sensitivity to infrared ray. Standard point of optical density for determination of sensitivity was the point of density 0.75 in all cases. Unexposed samples were treated in the same manner as above to measure fog density.

Handleability under safelight was evaluated by fog (after exposure with safelight) which occurred when the sample was exposure for 20 minutes with a 10 W tungsten lamp at a distance of 2 m through safelight filter No. 4 of Fuji Photo Film Co. on which Toshiba color glass filter IRA-05 and a paraffin oil paper were superposed.

The results are shown in Table 1.

TABLE 1

| | | Exposure to dark red light | | | | |
|---|---|---|---|---|---|---|
| No. | Emulsion | Relative sensitivity | $\bar{\gamma}$ | Dmax | Fog | Fog after exposure to safelight |
| | A (Comparative) | 100 | 1.8 | 1.85 | 0.06 | 0.16 |
| | B The present invention | 112 | 2.5 | 1.98 | 0.06 | 0.08 |

TABLE 1-continued

| | | Exposure to dark red light | | | | |
|---|---|---|---|---|---|---|
| No. | Emulsion | Relative sensitivity | $\bar{\gamma}$ | Dmax | Fog | Fog after exposure to safelight |
| | vention | | | | | |

From the above results, it can be seen that sample B of the present invention was superior in safety in handling under safelight without damaging sensitivity to infrared ray. It can be also seen that high contrast and high maximum density can be obtained.

EXAMPLE 2

Emulsions were prepared by mixing and ripening in the same manner as in Example 1 except that 50 mg of each of the compounds as shown in Table 2 which was dissolved in methanol was previously added to liquid I and the resulting emulsions were observed by an electron microscope. The results are shown in Table 2.

TABLE 2

| Compound | Grain size distribution | Average grain size | Form |
|---|---|---|---|
| Blank | 0.4~1.5 | 0.7 | Cubic.Octahedral |
| I-1 | 0.3~0.75 | 0.5 | Cubic |
| I-2 | 0.4~0.95 | 0.6 | Cubic |
| I-3 | 0.35~1.0 | 0.6 | Cubic |
| I-5 | 0.35~0.8 | 0.5 | Cubic |
| I-7 | 0.3~0.7 | 0.45 | Cubic |
| I-9 | 0.4~0.95 | 0.6 | Cubic |
| I-12 | 0.35~0.7 | 0.55 | Cubic |
| I-15 | 0.35~0.9 | 0.55 | Cubic |
| I-16 | 0.35~0.1 | 0.6 | Cubic |
| I-17 | 0.4~0.65 | 0.55 | Cubic |
| I-18 | 0.35~0.7 | 0.6 | Cubic |
| I-19 | 0.3~0.65 | 0.45 | Cubic |
| I-20 | 0.35~0.75 | 0.6 | Cubic |
| I-21 | 0.3~0.6 | 0.45 | Cubic |

These emulsions were subjected to chemical sensitization and spectral sensitization and then to the tests in the same manner as in Example 1. The samples of the present invention were superior to the blank in safety in handling under safelight without damaging the sensitivity to infrared ray. Further, high maximum density was obtained in the samples of the present invention.

EXAMPLE 3

Emulsions A and B after subjected to chemical sensitization in Example 1 were divided into portions and to each of them was added sensitizing dye (1), (9), (10), (11) or (31) in an amount of 10 mg per 1 mol of silver halide. Then, each of them was subjected to the same treatments as in Example 1 and thus finished emulsion was tested in the same manner as in Example 1.

The results are shown in Table 3.

TABLE 3

| | Emulsion A (Comparative) | | | | |
|---|---|---|---|---|---|
| | Exposure to dark red light | | | | |
| Sensitizing dye | Relative sensitivity | $\bar{\gamma}$ | Dmax | Fog | Fog after exposure to safelight |
| 1 | 100 | 1.6 | 1.80 | 0.05 | 0.15 |
| 9 | 100 | 1.9 | 1.83 | 0.06 | 0.18 |
| 10 | 100 | 1.8 | 1.85 | 0.06 | 0.16 |
| 11 | 100 | 1.7 | 1.75 | 0.06 | 0.16 |
| 31 | 100 | 1.7 | 1.81 | 0.06 | 0.17 |
| | Emulsion B (The present invention) | | | | |

TABLE 3-continued

| Exposure to dark red light | | | | |
|---|---|---|---|---|
| Relative sensitivity | $\bar{\gamma}$ | Dmax | Fog | Fog after exposure to safelight |
| 105 | 2.3 | 1.95 | 0.05 | 0.07 |
| 115 | 2.6 | 1.90 | 0.06 | 0.07 |
| 112 | 2.5 | 1.98 | 0.06 | 0.08 |
| 110 | 2.5 | 1.85 | 0.06 | 0.08 |
| 103 | 2.4 | 1.88 | 0.05 | 0.07 |

The relative sensitivity was a relative value when sensitivity of emulsion A was assumed to be 100.

From the above results, it can be seen that the emulsion B of the present invention provided high contrast and high maximum density and besides was superior in safety in handling under safelight without causing sensitivity to infrared ray.

EXAMPLE 4

A silver chlorobromide (silver bromide: 10 mol %) emulsion of 0.23 μm in average grain size was prepared. After precipitation and redissolution by water washing, gelatin: silver was adjusted to 0.6:1.0 and the emulsion was subjected to sulfur+gold sensitization. After completion of sensitization, the above exemplified dye (10) was added in an amount of $1\times10^{-4}$ mol per 1 mol of silver halide and then a hardener and a surface active agent were added thereto. This emulsion was divided into equal 10 portions and each of them was added the compound shown in Table 4 in an amount of $5\times10^{-1}$ mol per 1 mol of silver halide to obtain a finished emulsion.

Each of these emulsions was double layer-coated together with a protective layer (gelatin 1 g/m$^2$) on a polyester film at a coverage of 6 g/m$^2$ of silver to obtain a sample.

The sample was sensitometrically exposed through an interference filter having transmission maximum at 780 nm for $10^{-5}$ seconds, then developed with PQ developer, fixed, washed with water and dried. Then, characteristics were obtained.

The results are shown in Table 4. The sensitivity is expressed by relative value when that of sample 1 was taken to be 100.

TABLE 4

| Sample | Compound | Sensitivity | Fog |
|---|---|---|---|
| 1 | No | 100 | 0.20 |
| 2 | (I-1) | 160 | 0.08 |
| 3 | (I-5) | 180 | 0.07 |
| 4 | (I-7) | 180 | 0.07 |
| 5 | (I-9) | 170 | 0.07 |
| 6 | (I-10) | 150 | 0.09 |
| 7 | (Comparative a) | 20 | 0.12 |
| 8 | (Comparative b) | 50 | 0.12 |
| 9 | (Comparative c) | 50 | 0.15 |
| 10 | (Comparative d) | 105 | 0.10 |

The comparative compounds (a), (b), (c) and (d) used are shown below.

(Comparative a)

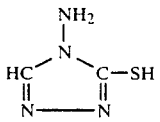

(Comparative b)

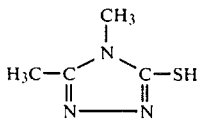

-continued (Comparative c)

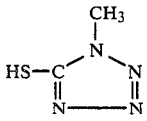

(Comparative d)

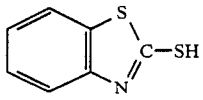

EXAMPLE 5

Example 4 was repeated except that a silver iodobromide (silver iodide: 2 mol %) emulsion prepared in the same manner was used as silver halide emulsion and the compound was added in an amount of $2\times10^{-1}$ mol. The results are shown in Table 5.

TABLE 5

| Sample | Compound | Sensitivity | Fog |
|---|---|---|---|
| 11 | No | 100 | 0.15 |
| 12 | (I-1) | 180 | 0.04 |
| 13 | (I-5) | 200 | 0.04 |
| 14 | (I-7) | 200 | 0.04 |
| 15 | (I-9) | 180 | 0.04 |
| 16 | (I-10) | 170 | 0.04 |
| 17 | (Comparative a) | 15 | 0.08 |
| 18 | (Comparative b) | 50 | 0.07 |
| 19 | (Comparative c) | 30 | 0.08 |
| 20 | (Comparative d) | 110 | 0.06 |

EXAMPLE 6

Example 4 was repeated except that dye (25) was used as the sensitizing dye. The results are shown in Table 6.

TABLE 6

| Sample | Compound | Sensitivity | Fog |
|---|---|---|---|
| 21 | No | 100 | 0.18 |
| 22 | (I-5) | 170 | 0.05 |
| 23 | (I-14) | 160 | 0.05 |
| 24 | (Comparative a) | 20 | 0.09 |
| 25 | (Comparative c) | 70 | 0.11 |
| 26 | (Comparative d) | 100 | 0.08 |

EXAMPLE 7

Example 6 was repeated except that dye (15), (23) or (28) was used in place of dye (25). The results were similar to those obtained in Example 6.

EXAMPLE 8

A silver chlorobromide (silver bromide: 10 mol %) emulsion of 0.23 μm in average grain size was prepared. After precipitation and redissolution by water washing, gelatin: silver was adjusted to 0.6:1.0 and the emulsion was subjected to sulfur+gold sensitization. After completion of sensitization, the above exemplified dye (10) was added in an amount of $1\times10^{-4}$ mol per 1 mol of silver halide and then a hardener and a surface active agent, were added thereto. This emulsion was divided into equal portions and to each of them was added the compound shown in Table 7 to obtain a finished emulsion.

Each of these emulsions was double layer-coated together with a protective layer (gelatin 1 g/m$^2$) on a polyester film at a coverage of 6 g/m$^2$ of silver to obtain a sample.

The sample was sensitometrically exposed through an interference filter having transmission maximum at 780 nm for $10^{-5}$ seconds, then developed with PQ developer, fixed, washed with water and dried. Then, characteristics were obtained.

The results are shown in Table 7. The sensitivity is expressed by relative value when that of sample 1 was assumed to be 100. Addition amount is mg per 1 mol of silver halide.

TABLE 7

| Sample | Compound (I); (mg) | Compound (II); (mg) | Sensitivity | Fog |
|---|---|---|---|---|
| 1 | — | — | 100 | 0.20 |
| 2 | (I-4) 70 | — | 210 | 0.07 |
| 3 | (I-4) 140 | — | 180 | 0.06 |
| 4 | — | (II-I) 100 | 170 | 0.09 |
| 5 | — | (II-I) 200 | 190 | 0.07 |
| 6 | (I-4) 70 | (II-I) 100 | 280 | 0.06 |
| 7 | (Comparative a) 70 | — | 40 | 0.11 |
| 8 | (Comparative a) 70 | (II-I) 100 | 130 | 0.07 |
| 9 | (Comparative b) | — | 60 | 0.11 |
| 10 | (Comparative b) 70 | (II-I) 100 | 140 | 0.07 |
| 11 | — | (Comparative c) 100 | 70 | 0.13 |
| 12 | (I-4) 70 | (Comparative c) 100 | 170 | 0.10 |

The above Table 7 shows that Sample No. 6 of the present invention has high sensitivity and is low in fog.

EXAMPLE 9

Example 8 was repeated except that a silver iodobromide (0.3 μm in average grain size) of silver iodide content 2 mol % was used and the compound as shown in Table 8 was added.

TABLE 8

| Sample | Compound (I) (mg) | Compound (II) (mg) | Sensitivity | Fog |
|---|---|---|---|---|
| 13 | — | — | 100 | 0.17 |
| 14 | (I-7) 50 | — | 180 | 0.08 |
| 15 | (I-7) 100 | — | 210 | 0.07 |
| 16 | (I-10) 50 | — | 160 | 0.09 |
| 17 | (I-10) 100 | — | 180 | 0.08 |
| 18 | (I-13) 50 | — | 170 | 0.08 |
| 19 | (I-13) 100 | — | 200 | 0.07 |
| 20 | — | (II-1) 50 | 190 | 0.10 |
| 21 | — | (II-1) 100 | 210 | 0.09 |
| 22 | — | (II-7) 50 | 180 | 0.11 |
| 23 | — | (II-7) 100 | 210 | 0.09 |
| 24 | (I-7) 50 | (II-1) 50 | 290 | 0.05 |
| 25 | (I-7) 50 | (II-7) 50 | 300 | 0.05 |
| 26 | (I-10) 50 | (II-1) 50 | 270 | 0.05 |
| 27 | (I-10) 50 | (II-7) 50 | 290 | 0.05 |
| 28 | (I-13) 50 | (II-1) 50 | 270 | 0.05 |
| 29 | (I-13) 50 | (II-7) 50 | 280 | 0.05 |

The above results show that Sample Nos. 24–29 have high sensitivity with low fog as in Example 8.

EXAMPLE 10

On one side of a support which had been coated with polyethylene resin on both sides was provided a matting layer containing silica particles of 5 μ in average particle size. On another side was provided an undercoat layer (adjusted to pH 4.5) containing carbon black and phenidone and 20% by weight based on the photographic gelatin of silica powder, 7 μm in average particle size. On the undercoat layer was provided a silver halide emulsion layer (adjusted to pH 4.5) containing 5% by weight (based on photographic gelatin) of silica powder of 7 μm in average particle size and 2-mercaptobenzoic acid, which had been chemically sensitized with a gold compound and hypo.

The silver halide emulsion contained sensitizing dye (13) in an amount of $1.0\times10^{-4}$ mol per 1 mol of silver halide and iridium in an amount of $5\times10^{-7}$ mol per 1 mol of silver halide which had been added during physical ripening of the emulsion. The silver halide was silver chloride grains in substantially cubic form which were 0.42 μ in average grain size and 90% of more of the total grains were distributed within ±30% of the average grain size.

The application rate of gelatin in the undercoat layer was 3.0 g/m², that of gelatin in the emulsion layer was 1.0 g/m² and that of silver halide was 1.0 g/m² in terms of silver nitrate. Both the undercoat layer and the emulsion layer contained 5.0 mg of formaldehyde as a hardener per 1 g of gelatin.

Optical reflective density of the undercoat layer at 780 nm was 0.83. After drying, the coated support was heated at 40° C. for 14 days. The emulsion layer was then coated with a nuclei coating composition of plate No. 11 in Example 1 of Japanese Patent Unexamined Publication (Kokai) No. 54-103104 to which 0.8 g/m² of hydroquinone was added (Comparative light sensitive material A).

Six light sensitive materials were prepared by adding the compound as shown in Table 9 to the silver halide emulsion of the comparative light sensitive material A.

These light sensitive materials were exposed for $10^{-5}$ second through an wedge of 0.15 in density difference to a light source to which a dark red filter which transmits light of longer than about 700 nm was attached.

Then, they were developed with known DTR developer and treated with an acidic neutralization solution. The results are shown in Table 9.

TABLE 9

| Sample | Compound (I) (mg) | Compound (II) (mg) | Sensitivity |
|---|---|---|---|
| A | — | — | 100 |
| B | (I-5) 50 | — | 160 |
| C | (I-5) 100 | — | 190 |
| D | — | (II-1) 100 | 150 |
| E | — | (II-1) 200 | 170 |
| F | (I-5) 50 | (II-1) 100 | 240 |
| G | (I-5) 100 | (II-1) 100 | 260 |

Each light sensitive material was subjected to proper exposure depending on sensitivity of each light sensitive material by a laser diode scanner Ultre Setter (Ultre Co.) which emits light at 780 nm.

Similarly, thus exposed materials were developed and neutralzed to make lithographic printing plates and printing was carried out using these printing plates. Lithographic printing plates made from light sensitive materials F and G were superior to comparative ones in printing endurance.

EXAMPLE 11

Example 10 was repeated except that dye (15), (23) or (28) was used in place of dye (13) to obtain the results similar to those obtained in Example 10.

What is claimed is:

1. A silver halide photographic light sensitive material which comprises one support and, provided thereon, at least a silver halide emulsion layer which is optically sensitized with a sensitizing dye having a maximum spectral sensitivity in the region of 700 nm or longer and has the following formula (III), (IV), (V) or (VI):

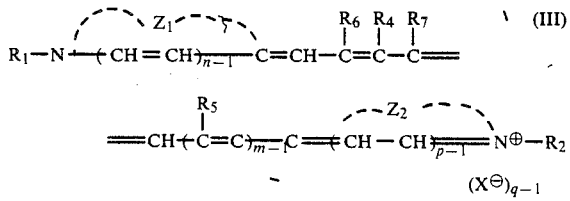

(III)

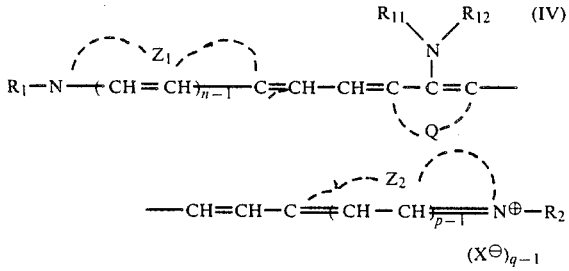

(IV)

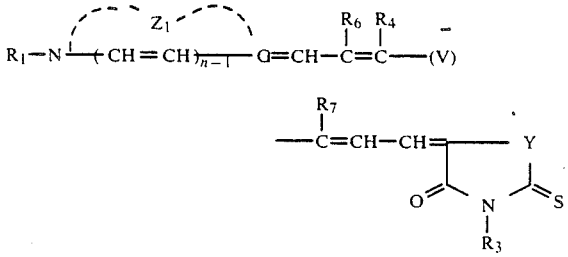

(V)

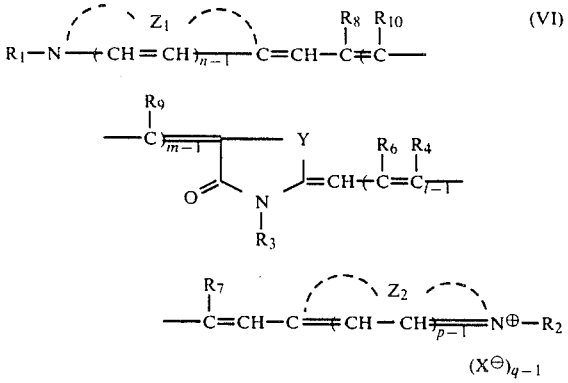

(VI)

wherein $Z_1$ and $Z_2$ which may be identical or different each represents a group of atoms necessary to form 5-membered or 6-membered nitrogen-containing heterocyclic ring; $R_1$ and $R_2$ which may be identical or different each represents an alkyl group or an alkenyl group; $R_3$ represents an alkyl group, an alkenyl group or an aryl group; $R_4$–$R_{10}$ which may be identical or different each represents a hydrogen atom, a halogen atom, an alkyl group, an aryl group or an alkoxy group and $R_6$ and $R_7$ or $R_8$ and $R_9$ may link to each other to form a 5-membered or 6-membered ring; $R_{11}$ and $R_{12}$ which may be identical or different each represents an alkyl group or an aryl group and may link to each other to form a 5-membered or 6-membered ring; Y represents a sulfur atom, an oxygen atom, $>N\text{-}R_{13}$ ($R_{13}$ is an alkyl group), X represents an acid anion; l, m, n, p and q each represents 1 or 2; and Q represents a group of atoms necessary to form a 5-membered or 6-membered ring; and which contains at least one compound represented by the following formula:

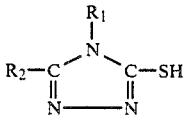

(I)

wherein $R_1$ and $R_2$ each represents a hydrogen atom, an alkyl group, an aryl group, an aralkyl group, an alkenyl group, an amino group, an acylamide group and a sulfonamide group and the total number of carbon atoms in $R_1$ and $R_2$ is at least 3.

2. A silver halide light sensitive material according to claim 1, wherein the emulsion layer additionally contains at least one compound represented by the following formula:

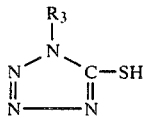

(II)

wherein $R_3$ represents an alkyl group of at least 3 carbon atoms or an aryl group.

3. A silver halide light sensitive material according to claim 1, wherein the amount of the compound represented by the formula (I) is $5\times10^{-3}$ mmol–5 mmols per 1 mol of silver halide.

4. A silver halide light sensitive material according to claim 2, wherein amount of the compound represented by the formula (I) and that of the compound represented by the formula (II) are respectively $5\times10^{-3}$ mmol–5 mmols.

5. A silver halide light sensitive material according to claim 1 wherein the compound is added to the emulsion before the, completion of physical ripening of the emulsion.

* * * * *